United States Patent [19]

Buchanan

[11] 4,332,116

[45] Jun. 1, 1982

[54] PREFABRICATED BUILDING STRUCTURE

[76] Inventor: Howard A. Buchanan, 1014 Dent La., Cumberland, Md. 21502

[21] Appl. No.: 148,592

[22] Filed: May 12, 1980

[51] Int. Cl.[3] ..... E04B 7/00; E04B 1/343

[52] U.S. Cl. ..... 52/82; 52/169.4; 52/236.1; 52/126.7

[58] Field of Search ..... 52/79.4, 236.1, 82, 52/236.2, 169.4

[56] References Cited

U.S. PATENT DOCUMENTS

| | | | |
|---|---|---|---|
| 2,361,272 | 10/1944 | Covey | 52/82 |
| 2,766,707 | 10/1956 | Foster | 52/82 |
| 3,152,366 | 10/1964 | McCrory | 52/79.4 |
| 3,520,508 | 7/1970 | Sewell | 248/354 P |
| 3,633,325 | 1/1972 | Bartoli | 52/82 |
| 3,655,161 | 4/1972 | Schueler | 248/354 P |
| 3,908,329 | 9/1975 | Walters | 52/82 |

FOREIGN PATENT DOCUMENTS

| | | | |
|---|---|---|---|
| 419564 | 3/1967 | Switzerland | 52/79.4 |

*Primary Examiner*—John E. Murtagh
*Attorney, Agent, or Firm*—Faith L. K. Silver

[57] ABSTRACT

A building, constructed from prefabricated building components, where the roof and floor components are formed from substantially similar triangle-shaped components. The roof and floor components are sequentially assembled and integrally fastened to the center support column of the building, so that the plan view of the building structure has the form of a polygon.

The floor components are each supported at the perimeter of the polygon by vertically adjustable support columns which allow for construction of the building on uneven terrain with minimum site preparation. The roof components are supported at the perimeter of the polygon by fixed vertical posts, between which posts may be included structural prefabricated wall components.

3 Claims, 5 Drawing Figures

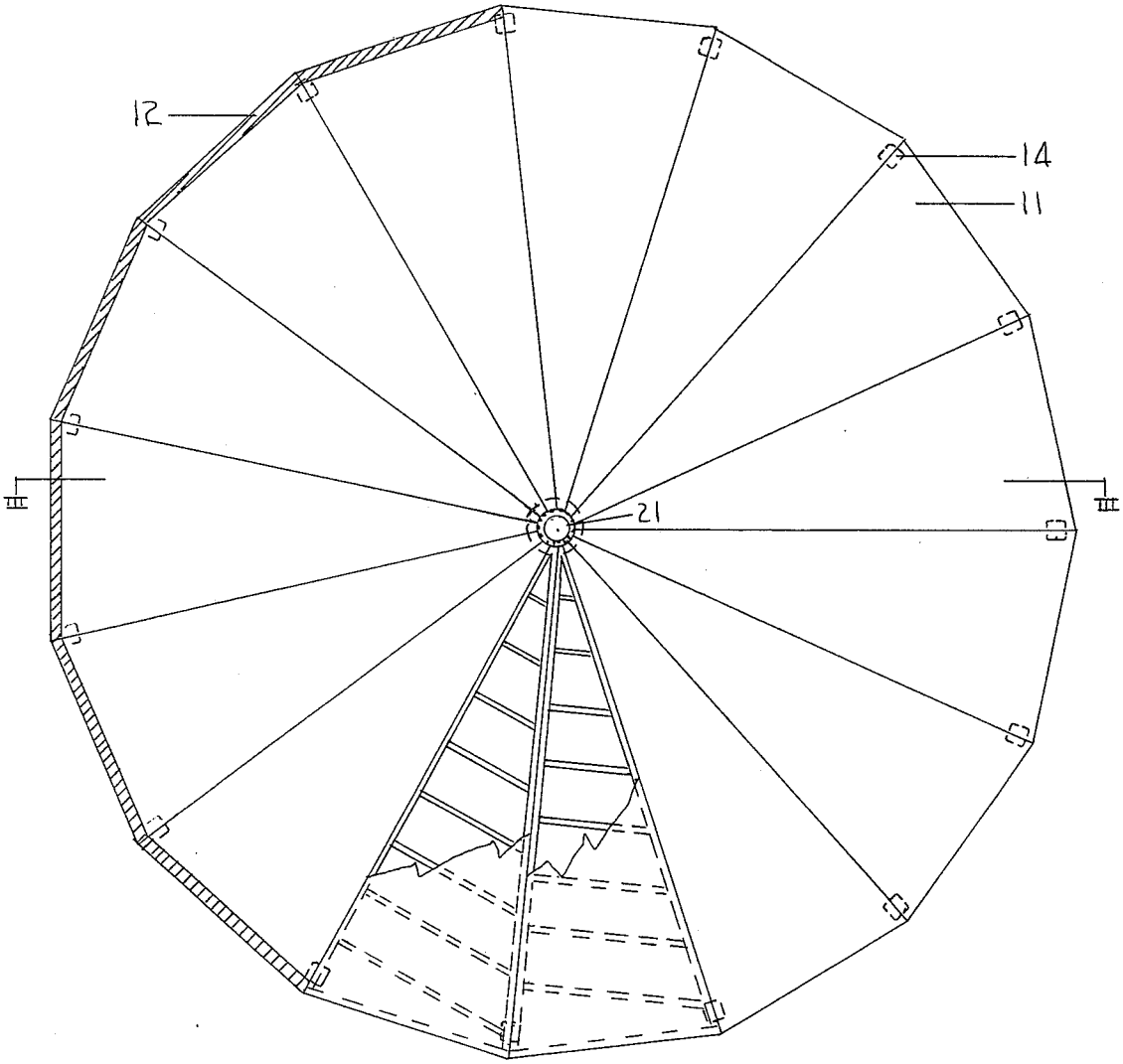
FIGURE II

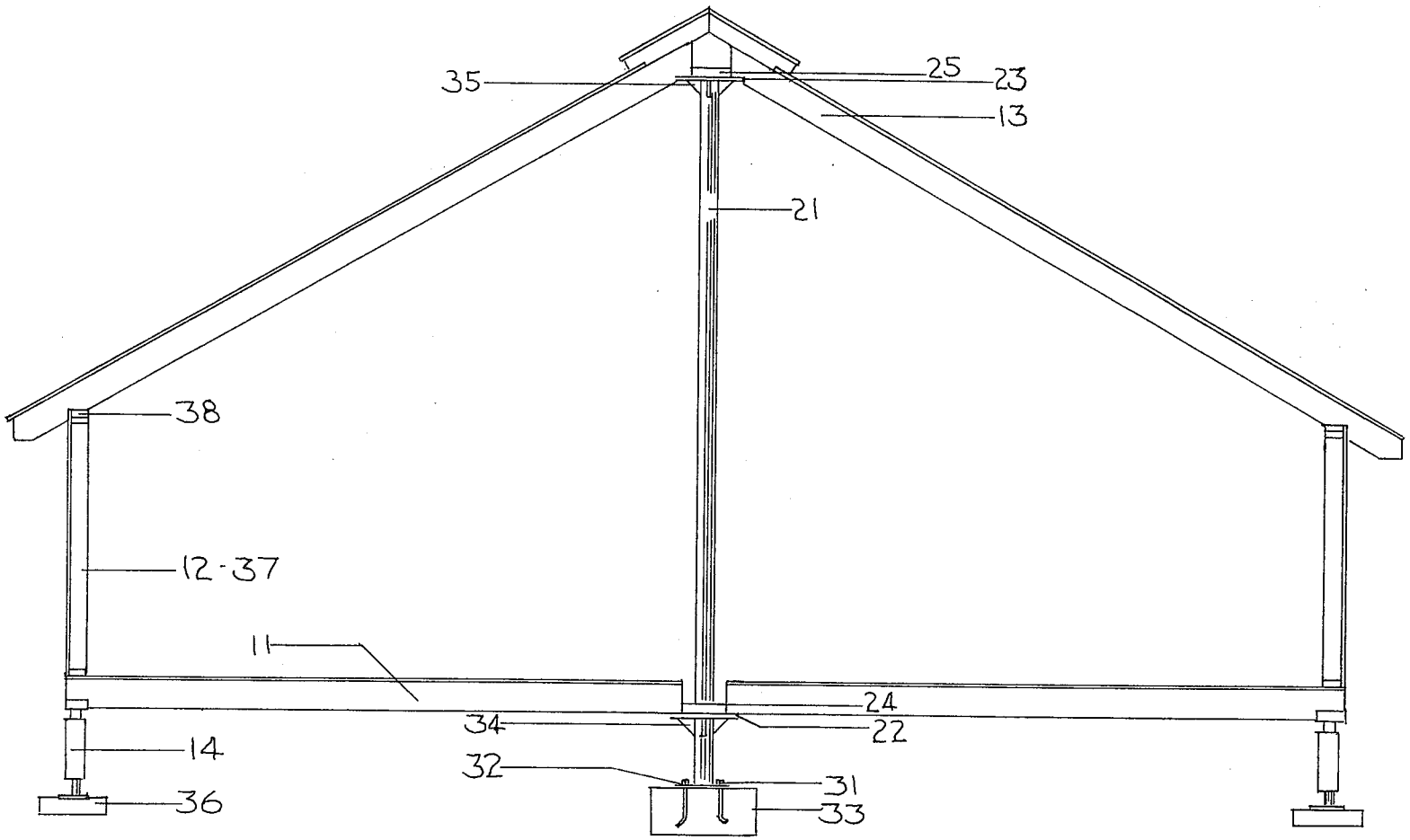
FIGURE III

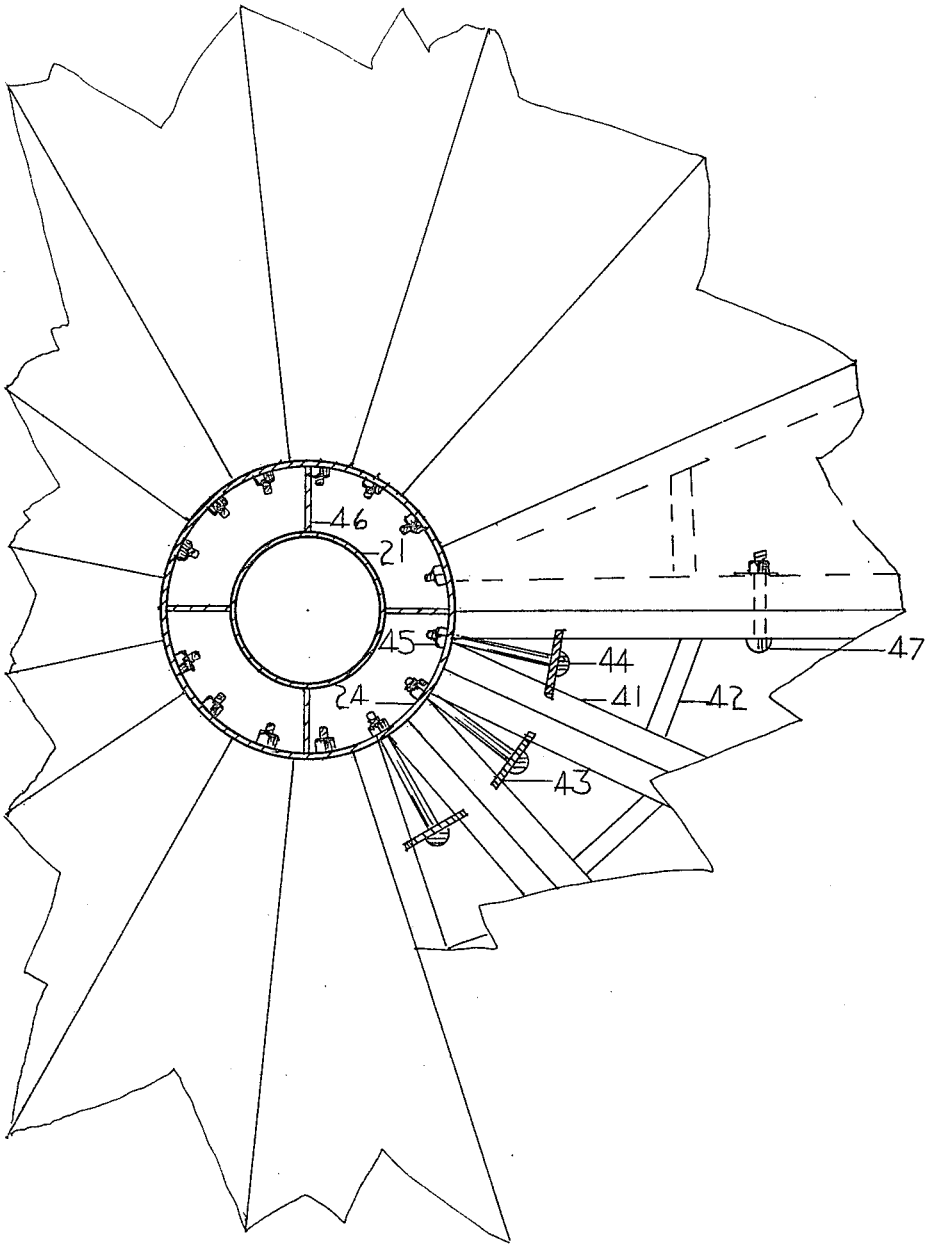
FIGURE IV

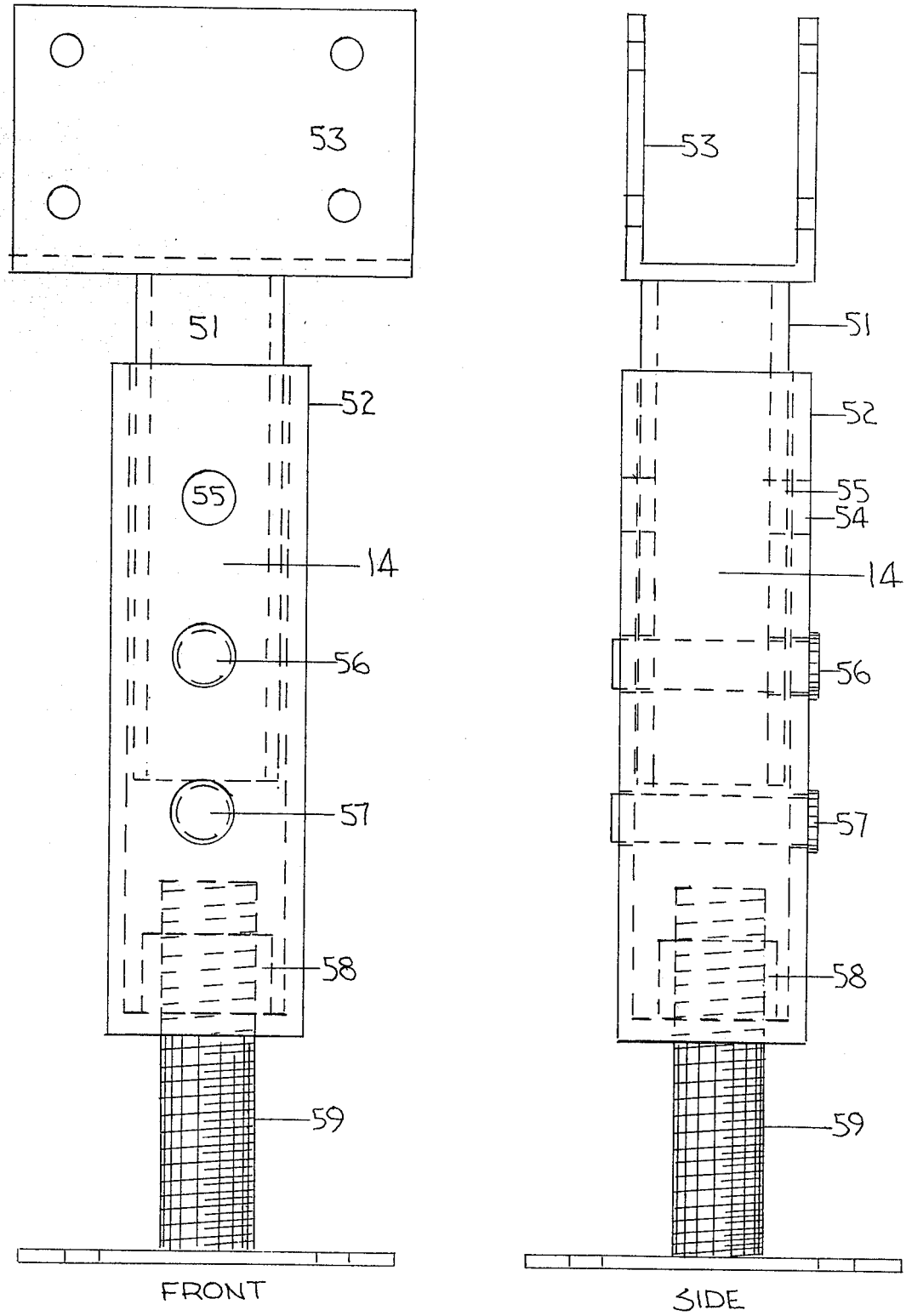
FIGURE V

PREFABRICATED BUILDING STRUCTURE

SUMMARY OF INVENTION

A building structure assembled from prefabricated building components, the plan view of which is a polygon comprising triangle-shaped floor components and triangle-shaped roof components integrally fastened to a central support column by a series of plates and bolts; which floor components are additionally supported and connected by a series of vertically adjustable perimeter columns.

BACKGROUND OF THE INVENTION

A need exists in the building industry for prefabricated building structures which may be erected quickly with minimal site preparation by people with relatively little job skills. Such structures should be able to withstand the natural elements, provide a large degree of usable interior space and be aesthetically pleasing to the eye. Prefabrication of building components can assure quality and standardization of parts by providing a factory controlled environment for production. Production losses due to adverse weather conditions can be minimized. Greatly increased efficiency results and aids in the reduction of construction costs.

The prefabricated building structure of the present invention uses a polygonal or "round" design. The "round" configuration of the present invention provides numerous advantages. One such advantage is that of providing a specified amount of interior floor space within less outside wall space (perimeter feet) than a comparable square or rectangular building, because the circumference of a circle is less than the perimeter of a rectangle for a given area. For example, a round building with 1000 square feet has approximately 112 perimeter feet. A rectangular building with 1000 square feet could be 20'×50' having a perimeter of 140 feet. Since heat loss is directly proportional to the number of perimeter feet (outside wall space), heat loss in the present invention is greatly reduced. Other advantages include minimized interior obstructions and increased outside wall strength inherent to a curved or arch segment.

The structure of the present invention is extremely flexible as to usage because of the minimized interior obstructions. The structure has only one interior central support column. The finished structure may have residential, commercial, recreational, or educational use. The structure may be totally enclosed or partially opened. Walls may be constructed from conventional building materials or may utilize large expanses of glass or solar type glass panels.

The roof and floor components of the invention utilize smaller lumber sizes than conventional construction which has the effect of utilizing random lumber lengths, thus conserving lumber and reducing material costs. Further, the roof and floor components possess a triangle-shape symmetry which enables them to be easily stacked or nested for storage and shipment.

The vertically adjustable perimeter columns of the present invention allow for minimal site preparation on uneven terrain. Conventional poured footings, foundations and masonry walls are all eliminated. Reduced construction time and reduced costs are a result.

The building structure of the present invention requires no skilled masons, concrete finishers, or carpenters for construction. The structure may be constructed, using six men with minimal labor skills, in approximately eight hours.

DESCRIPTION OF THE DRAWINGS

The invention will be better understood by reference to the attached drawings in which.

Figure 1:
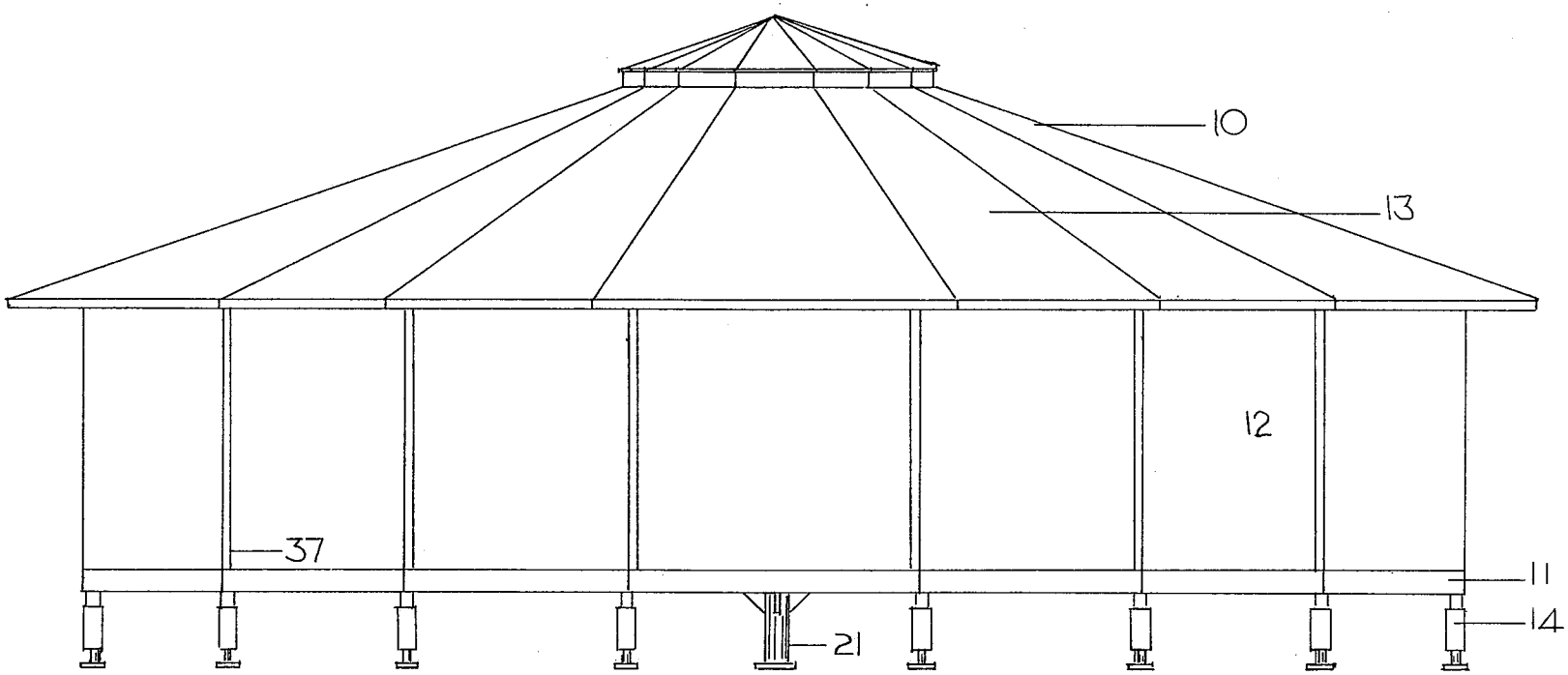
FIG. 1 is a perspective view of the building structure constructed from prefabricated components.

FIG. II is a plan view of the basic floor component assembly;

FIG. III is a sectional view taken along line III—III of FIG. II;

FIG. IV is a detailed top view of a floor component and fastening arrangement;

FIG. V is a detailed elevation illustrating an adjustable perimeter column, showing both front and side view.

DETAILED DESCRIPTION OF THE INVENTION

Referring to the figures, the building structure 10 shown in FIG. I is constructed from prefabricated building components, comprising floor components 11 (detailed illustration in FIGS. II, III, and IV), wall components 12 and roof components 13. The structure is supported by central support column 21 (see FIGS. II, III, and IV) and adjustable perimeter columns 14. The building shown may be assembled by non-skilled labor on uneven terrain with minimal site preparation.

As best shown in FIG. II, the building structure is assembled from fifteen floor components 11, each floor component having the shape of an isosceles triangle. Each triangular floor component is supported by and fastened to central support column 21 at the point at which the two equal sides of the isosceles triangle are joined. Each of the fifteen triangular floor components contains a 24° angle incorporated between the two equal sides of the isosceles triangle, the sum of which angles, when the triangular floor components are assembled in sequence about the central support column, total 360°. In like manner, the building structure is constructed from fifteen triangle-shaped roof components, each triangle supported by central support column 21.

In FIG. III, which is a sectional view taken along line III—III of FIG. II, the central supoort column 21 is shown supporting floor components 11. The floor components are supported by support plate 22, which plate is welded to the central column 21. Floor components 11 are fastened to central column 21 by a series of plates 43 and bolts 44 (detailed in FIG. IV) which are joined to vertical flange 24 projecting from support plate 22 to form a tension ring.

The central support column 21 is typically a 6" ISD standard weight steel column (OSD=6.625") bolted by means of ½" thick steel base plate 31 and anchor bolts 32 to concrete base 33.

The support plate 22 is typically a ⅝" thick ×24" square steel plate welded to the central support column 21 and reinforced by five ¼" thick steel plate triangular stiffeners 34. The support plate 22 is welded to column 21 at a typical distance of 36" from base plate 31.

Also in FIG. III, the central support column is shown supporting roof components 13. The roof components are supported by support plate 23, which plate is welded to central column 21. In a similar manner to the floor component assembly, which will be detailed in FIG. IV, roof components 13 are fastened to central column 21 by a series of plates and bolts which are joined to vertical flange 25 projecting from round support plate 23.

The support plate 23 is typically a $\frac{5}{8}''$ thick round steel plate of 24" diameter welded to the central support column 21 and reinforced by five $\frac{1}{4}''$ thick steel plate triangular stiffeners 35. The support plate 23 is welded to central column 21 at a typical distance 209" from base plate 31.

Each floor component 11 is supported on its outer edge and connected to adjacent floor components by a vertically adjustable perimeter column 14. The perimeter columns 14 are supported by pre-cast or poured-in-place concrete bases 36. Adjustable perimeter columns are detailed in FIG. V.

Each roof component 13 is supported near its outer edge and connected to adjacent roof components by fixed vertical posts 37 supported on floor components 11. Vertical posts 37 are typically 4×4 wood posts and are capped with "U"-shaped steel brackets 38, which receive and connect adjacent roof components. In cases where wall components are contiguous, the support function may be accomplished by means of adjacent 2×4 studs, which are integral parts of the wall.

The floor components 11 and their fastening arrangement are best illustrated in FIG. IV. Each floor component 11 is constructed from two wood stringers 41, framed to form an isosceles triangle having an angle of 24° between the two equal sides. The wood stringers 41 are nailed together at one end and are joined further along the lengths of wood stringers 41 by cross joists 42.

Wood stringers 41 are typically 2×12 wood timbers, each 18' long. Cross joints 42 are typically 2×6 wood timbers joining wood stringers 41 at 16" intervals along the length of the wood beams.

Each wood stringer 41 is gained (grooved cross grain) on its side in order to receive one end of steel plate 43. Additionally, each wood stringer 41 has a notched end wherein a slot is formed at the position where the two stringers are joined in order to receive carriage bolt 44. Steel plate 43 is typically $\frac{1}{4}''\times2\frac{1}{2}''\times5''$, which is pre-punched in order to receive carriage bolt 44.

Floor component 11 is fastened to the central column 21 by positioning steel plate 43 between gained stringers 41 and positioning carriage bolt 44 through steel plate 43 and through vertical flange 24. Nut 45 is then positioned and tightened on the protruding end of carriage bolt 44. When all floor components 11 are fastened to central column 21, a tension ring is formed.

Vertical flange 24 projects from support plate 22 and is typically $\frac{1}{4}''\times5''$ steel plate, having a circumferential of 45", pre-drilled with fifteen apertures, 3" apart o.c., to receive carriage bolts 44. Vertical flange 24 is reinforced with four $\frac{1}{4}''$ steel webs 46, which are welded to column 21.

Wood stringers 41 are additionally pre-drilled holes along their lengths in order to receive additional bolts 47 that connect adjacent floor components. These stringers, thus joined, form beams which extend from the center column 21 every 24".

Floor components are typically covered with plywood sub-flooring which subsequently may be carpeted or tiled, dependent on the intended use; or, floor components may be covered with treated pine wood decking in order to provide the floors with a weather resistant covering, if the building structure is to be open to the elements.

The roof components 13 and their fastening arrangement are similar in design to the floor component assembly. Each roof component is also constructed from two wood stringers, framed to form an isosceles triangle having an angle of 24°, incorporated between the two equal sides and further connected by cross joists. The difference between the prefabricated floor components and roof components is that the wood beams of the roof components are longer, in order to provide an eave projection or overhang on the building structure.

The wood stringers of the roof components are typically 2×10 wood timbers, each typically 22' long. Cross joists of the roof components are typically 2×6 wood timbers joining wood stringers at 24" intervals along the length of the wood stringers. The ends of the wood stringers of the roof components are cut on an angle which is determined by the roof pitch. Typically, a 4:12 pitch would produce an angle of 66°.

The identical plate and bolt fastening assembly as described for the floor components assembly is used to fasten roof components 13 to vertical flange 25 projecting from support plate 23 welded to central column 21.

Roof components are typically covered with plywood, which is subsequently covered with felt and conventional roofing materials, such as roof shingles, aluminum or corrugated sheet metal.

The vertically adjustable perimeter column 14, as detailed in FIG. V, is constructed from two telescoping steel tubes 51 and 52. Inner tube 51 is capped by "U"-shaped steel bracket 53, which receives and connects adjacent floor components. Outer tube 52 is provided with vertically spaced apertures 54. Inner tube 51 is provided with vertically spaced apertures 55. Inner tube 51 is supported within outer tube 52 when one of the vertically spaced apertures 55 is aligned with one of the vertically spaced apertures 54, and a support pin 56 is positioned through both tubes by means of the aligned apertures 54 and 55. Additionally, the exterior rim of inner tube 51 is supported on a second support pin 57 which is positioned through outer tube 52. Inner tube 51 may be raised or lowered by aligning apertures 55 with the successively spaced apertures 54 of outer tube 52. Outer tube 52 is fitted to receive one end of a threaded adjustment sleeve 58. Outer tube 52 may be raised or lowered by means of threaded screw 59.

Minor adjustments to the terrain are made by raising or lowering the column by means of threaded adjustment screw 59. Major adjustments to the terrain are made by raising or lowering the column by realigning aperture 55 of inner tube 51 with successively space apertures 54 of outer tube 52.

Outer tube 52 is typically $4''\times4''\times\frac{1}{4}''$ square steel tubing.

Apertures 54 are typically spaced 3" apart. Inner tube 51 is typically $3\frac{1}{2}''\times3\frac{1}{2}''\times\frac{1}{4}''$ square steel tubing.

Wall components 13, as best shown in FIG. I, are prefabricated to fit between fixed vertical posts 37. The wall components may be varied according to building use or architectural requirements. Such variations include plain walls, or walls which include a patio door, entrance door, privacy window or picture window, or walls which are all glass. Of the fifteen perimeter wall segments, five must be structural wall components to provide strength for the building. As many as ten wall components may be omitted, resulting in an open pavilion-type structure.

Typical wall components are as long as the base of each floor component, or typically 7'8" wide and 8' high. Structural wall components are constructed from ⅝" plywood sheathing, using 2×4 studs at 16" intervals. The interior of the wall components may be covered with conventional wall materials such as gypsum or wood paneling. The exterior may be covered with any residential or commercial siding material.

The concrete bases 36 supporting each vertically adjustable perimeter column 14 and the concrete base 33 supporting center column 21, as shown in FIG. III, are necessary to resist settling and frost eruption in Northern climates. The bases may be formed by boring a hole in the ground, to a specified depth, and filling the holes with concrete. These bases provide support under the building structure and prevent frost heaving. Site preparation is minimal, in that there is no requirement to level or form these concrete bases.

Although a single story building is illustrated, the invention is not restricted to buildings of one story. An additional story could be added to the structure by increasing the height of the center column and perimeter columns to allow for ceiling clearance under the floor components and providing a concrete slab for the first floor. The floor component assembly, as detailed in FIG. IV, would be supported on perimeter columns 8' above the concrete slab and would constitute the second floor of the building structure. The roof component assembly would be supported on 4×8 vertical posts and/or structural wall components which would bear on the floor component assembly. A stairway would be provided between floors near the perimeter of the building.

Although the invention as described herein is a fifteen sided polygon, building structures having a plan view of a polygon with any number of sides may be constructed using the principles of this invention.

I claim as my invention:

1. A building structure formed from prefabricated building components, the plan view of which is a polygon having a central support column;

a plurality of floor components with each floor component having the shape of an isosceles triangle, and wherein each floor component is fastened to the center support column at the point where the two equal sides of the isosceles triangle are joined, and wherein the floor components are sequentially assembled and fastened to said center support columm, the sum of the angles incorporated between the two equal sides of each isosceles triangle of the assembled floor components totaling 360°;

a plurality of roof components with each roof component having the shape of an isosceles triangle, and wherein each roof component is fastened to the center support column at the point where the two equal sides of the isosceles triangle are joined, and wherein the roof components are sequentially assembled and fastened to said center support column, the sum of the angles incorporated between the two equal sides of each isosceles triangle of the assembled roof components totaling 360°;

a plurality of vertically adjustable columns supporting and connecting said floor components at the perimeter of the polygon;

wherein the improvement comprises:

a. said triangle-shaped floor components are each formed from two wood stringers of equal lengths joined together at one end and having at least one cross joist;

b. said triangle-shaped roof components are each formed from two wood stringers of equal lengths joined together at one end and having at least one cross joist;

c. said wood stringers each have a notched end so that a slot is formed at the point of each triangle-shaped component where said stringers are joined;

d. said wood stringers are gained;

e. each triangle-shaped floor component and each triangle-shaped roof component have a steel plate with a single aperture, said steel plate positioned between said two gained wood stringers;

f. said central support column has a first support plate welded thereto and a first vertical flange projecting from said first support plate and circularly disposed about said central support column, said first vertical flange having a plurality of evenly spaced apertures along the circumference of said flange;

g. said central support column has a second support plate welded thereto and a second vertical flange projecting from said second support plate and circularly disposed about said central support column, said second vertical flange having a plurality of evenly spaced apertures along the circumference of said flange;

h. said triangle-shaped floor components are supported by and integrally fastened to said first support plate by means of a bolt positioned through the single aperture in said steel plate and through the slot formed by said joined stringers and through one of the plurality of apertures in said first vertical flange; and said triangle-shaped roof components are supported by means of a bolt positioned through the single aperture in said steel plate and through the slot formed by said joined stringers and through one of the plurality of apertures in said second vertical flange.

2. A building structure formed from prefabricated building components, the plan view of which is a polygon as recited in claim 1, wherein:

a. said triangle-shaped floor components number fifteen, each component formed from two wood stringers of equal lengths having an angle of 24° incorporated between said lengths;

b. said triangle-shaped roof components number fifteen, each component formed from two wood stringers of equal lengths having an angle of 24° incorporated between said lengths; and c. said vertically adjustable columns number fifteen.

3. A building structure formed from prefabricated building components, the plan view of which is a polygon as recited in claim 2, including:

a. fifteen vertical posts supporting and connecting said fifteen roof components whch vertical posts are supported by said floor components near the perimeter of the polygon; and b. at least five structural wall components fitted between adjacent vertical posts.

* * * * *

UNITED STATES PATENT AND TRADEMARK OFFICE

CERTIFICATE OF CORRECTION

PATENT NO. : 4,332,116

DATED : June 1, 1982

INVENTOR(S) : Howard A. Buchanan

It is certified that error appears in the above-identified patent and that said Letters Patent is hereby corrected as shown below:

Column 6, claim 1, after line 36 the following should be added:

--i. said triangle-shaped roof components are supported by and integrally fastened to said second support plate by means of a bolt positioned through the single aperture in said steel plate and through the slot formed by said joined stringers and through one of the plurality of apertures in said second vertical flange--.

Signed and Sealed this

*Tenth* Day of *August 1982*

[SEAL]

*Attest:*

GERALD J. MOSSINGHOFF

*Attesting Officer*

*Commissioner of Patents and Trademarks*